US008434269B1

(12) United States Patent
Brochu

(10) Patent No.: US 8,434,269 B1
(45) Date of Patent: May 7, 2013

(54) EAVESTROUGH COVER

(76) Inventor: Stephane Brochu, St-Romuald (CA)

( * ) Notice: Subject to any disclaimer, the term of this patent is extended or adjusted under 35 U.S.C. 154(b) by 0 days.

(21) Appl. No.: 13/507,775

(22) Filed: Jul. 27, 2012

(51) Int. Cl.
*E04D 13/076* (2006.01)

(52) U.S. Cl.
USPC ..... 52/12

(58) Field of Classification Search ..... 52/12; D23/261, D23/267
See application file for complete search history.

(56) References Cited

U.S. PATENT DOCUMENTS 2,271,081 A * 1/1942 Layton ..... 52/12
5,010,696 A * 4/1991 Knittel ..... 52/12
5,557,891 A * 9/1996 Albracht ..... 52/12
5,660,001 A * 8/1997 Albracht ..... 52/12
6,098,344 A * 8/2000 Albracht ..... 52/12
6,412,228 B1 * 7/2002 Meckstroth ..... 52/12
D523,538 S * 6/2006 Brochu ..... D23/267
7,104,012 B1 * 9/2006 Bayram ..... 52/12
8,322,082 B2 * 12/2012 Neumann ..... 52/12
2007/0169423 A1 * 7/2007 Brochu ..... 52/12
2008/0010906 A1 * 1/2008 Brochu ..... 52/12
2012/0151849 A1 * 6/2012 Brochu ..... 52/12

* cited by examiner

*Primary Examiner* — Robert Canfield
(74) *Attorney, Agent, or Firm* — Eric Fincham

(57) ABSTRACT

An eavestrough cover comprising a first side structure and a second side structure with a central planar portion intermediate the side structures, the central portion having a plurality of longitudinally extending sections with each being separated from each other by a rollback member, the rollback members extending longitudinally and having one face thereof of a C-shaped configuration, all of the rollbacks facing in the same direction, each of the longitudinally extending sections having a plurality of apertures formed therein. The rollback structure helps prevent overflow of the eavestrough.

14 Claims, 2 Drawing Sheets

EAVESTROUGH COVER

FIELD OF THE INVENTION

The present invention relates to a cover for an eavestrough.

BACKGROUND OF THE INVENTION

The use of covers for gutters or eavestroughs is well known in the art and there have been many proposals for different types of covers. The purpose of the cover is essentially to permit the passage of rainwater from the roof to the eavestrough while protecting the same from extraneous foreign matters such as leaves, twigs and the like.

There have been several different approaches which have been proposed in the prior art with respect to the design of covers. A first approach which is widely used is a cover which is foraminous and permits passage of rainwater while attempting to bar the passage of extraneous matter. There are many different designs with some of these not functioning as well as might be desired. In order to overcome problems, it has also been proposed that the eavestrough itself be mounted for pivotal movement such that it may be emptied at desired intervals.

A still further approach which has been taken is utilizing a design wherein a cover has an outer edge which fills downwardly and the water follows a curved portion due to surface tension and thereafter cascades into the eavestrough. While this structure works under certain conditions, when the volume of water becomes sufficiently large, the surface tension is insufficient to direct all the water into the eavestrough.

SUMMARY OF THE INVENTION

It is an object of the present invention to provide a cover for an eavestrough which can handle relatively high flows of water while preventing the entry of extraneous material.

According to one aspect of the present invention, there is provided a cover for an eavestrough comprising a first side structure and a second side structure, a central planar portion intermediate the first side structure and the second side structure, the central portion having a plurality of longitudinally extending sections, each of the longitudinally extending sections being separated from each other by a rollback member, each of the rollback members extending longitudinally and having one face thereof of a C-shaped configuration, each of the faces having a C-shaped configuration facing the same direction towards the second side structure, and each of the longitudinally extending sections having a plurality of apertures formed therein.

According to a further aspect of the present invention, there is also provided in combination, an eavestrough having a rear wall, a bottom wall, a front wall, and an inwardly extending top wall section joining the front wall, and a cover for the eavestrough, the cover comprising a first side structure and a second side structure, a central planar portion intermediate the first side structure and the second side structure, the central portion having a plurality of longitudinally extending sections, each of the longitudinally extending sections being separated from each other by a rollback member, each of the rollback members extending longitudinally and having one face thereof of a C-shaped configuration, each of the faces having a C-shaped configuration facing the same direction towards the second side structure, and each of the longitudinally extending sections having a plurality of apertures formed therein.

The cover of the present invention utilizes a plurality of "rollbacks" which are structures designed to redirect the flow of water to prevent overflow of the eavestrough. These rollbacks extend longitudinally of the cover and prevent a rush of water from running to the side and then overflowing.

The device of the present invention may be formed of any suitable material and is conveniently formed either of metallic or plastic material. As is known in the art, metallic materials such as aluminum may conveniently be used. However, it is within the scope of the present invention for one to use other materials and they may either be similar or dissimilar.

The device of the present invention prevents foreign matter from entering into the eavestrough. In order to do so, there are provided a plurality of apertures to permit the passage of rainwater through the cover while still preventing extraneous matter from entering the eavestrough. Sizing of the apertures is well known in the art and generally they will have a size of between 2.5 and 10 mm.

The first side structure may be adjacent the front wall of an eavestrough and may be secured to a top wall of a K type eavestrough. The cover is also provided with a channel adjacent to the front wall of the eavestrough. The channel is defined by a pair of walls and at the bottom of which, there is provided an opening to aid in drainage of the water. The second side structure will preferably include a sealing strip which is retained by the second side structure. The sealing strip is preferably of a flexible material and is designed to abut the eaves to prevent water from going between the second side structure and the eave.

The number of rollbacks formed in the cover may vary. Any number between two and six are preferred. Each rollback preferably extends a height above the planar portions of between 1 mm and 6 mm.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
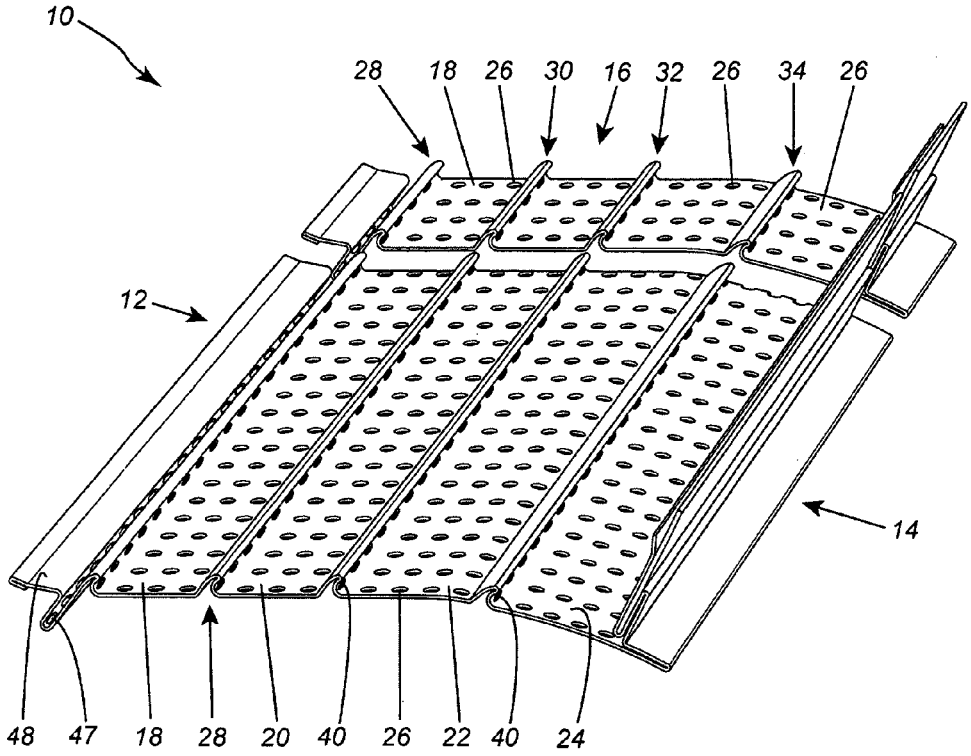
FIG. 1 is a perspective view of a cover for an eavestrough according to one embodiment of the present invention.
Figure 2:
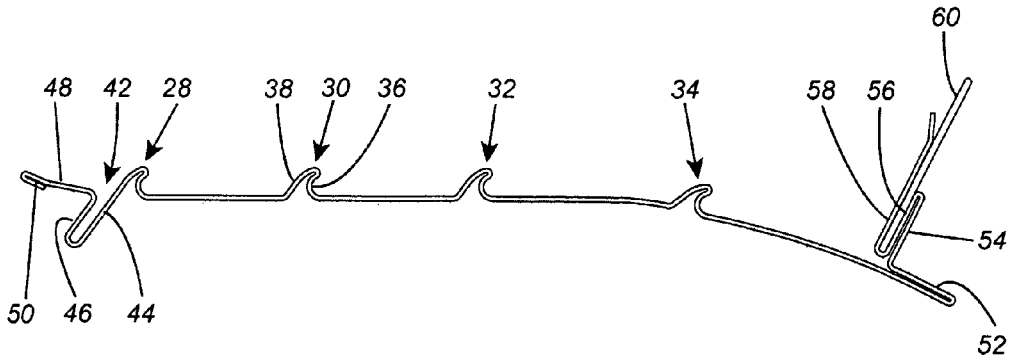
FIG. 2 is an end elevational view thereof.

Referring to the drawings in greater detail and by reference characters thereto, there is illustrated in FIG. 1 a cover generally designated by reference numeral 10 which can be utilized with a conventional K type eavestrough. Naturally, it can also be utilized with other types of eavestrough with or without modifications.

Cover 10 includes a first side structure generally designated by reference numeral 12 and a second side structure generally designated by reference numeral 14. Intermediate first side structure 12 and second side structure 14 is a central portion generally designated by reference numeral 16.

Central portion 16 includes a plurality of longitudinally extending sections 18, 20, 22 and 24. Each of sections 18, 20, 22 and 24 has apertures 26 therein to permit the passage of water therethrough. Separating the longitudinally extending sections 18, 20, 22 and 24 are rollbacks 28, 30, 32 and 34. Each rollback has a substantially identical configuration and thus only one will be described herein. Rollback 28 has a wall 36 having a C-shaped or concave configuration. Rollback 28 also includes a second back wall 38. It will be noted that there are provided apertures 40 in wall 36.

Adjacent first side structure 12 is a trough 42 defined by first trough wall 44 and a second trough wall 46. Again, it will be seen that apertures 47 are provided at the bottom of trough 42. A flange 48 extends outwardly from second trough wall 46. Flange 48 includes a doubled under segment 50. Flange 48 is designed to be secured to the eavestrough by suitable mechanical fasteners.

Second side structure 14 includes a doubled back segment 52 which then merges with an upwardly extending wall 54 and a downwardly extending wall 56. The structure terminates with an upwardly extending wall 58. A sealing strip 60 is retained between downwardly extending wall 56 and upwardly extending wall 58.

The provision of rollbacks 28, 30, 32, and 34 assist in preventing the overflow of excess water over the edge and which would tend to stain the front wall of the eavestrough.

Figure 3:
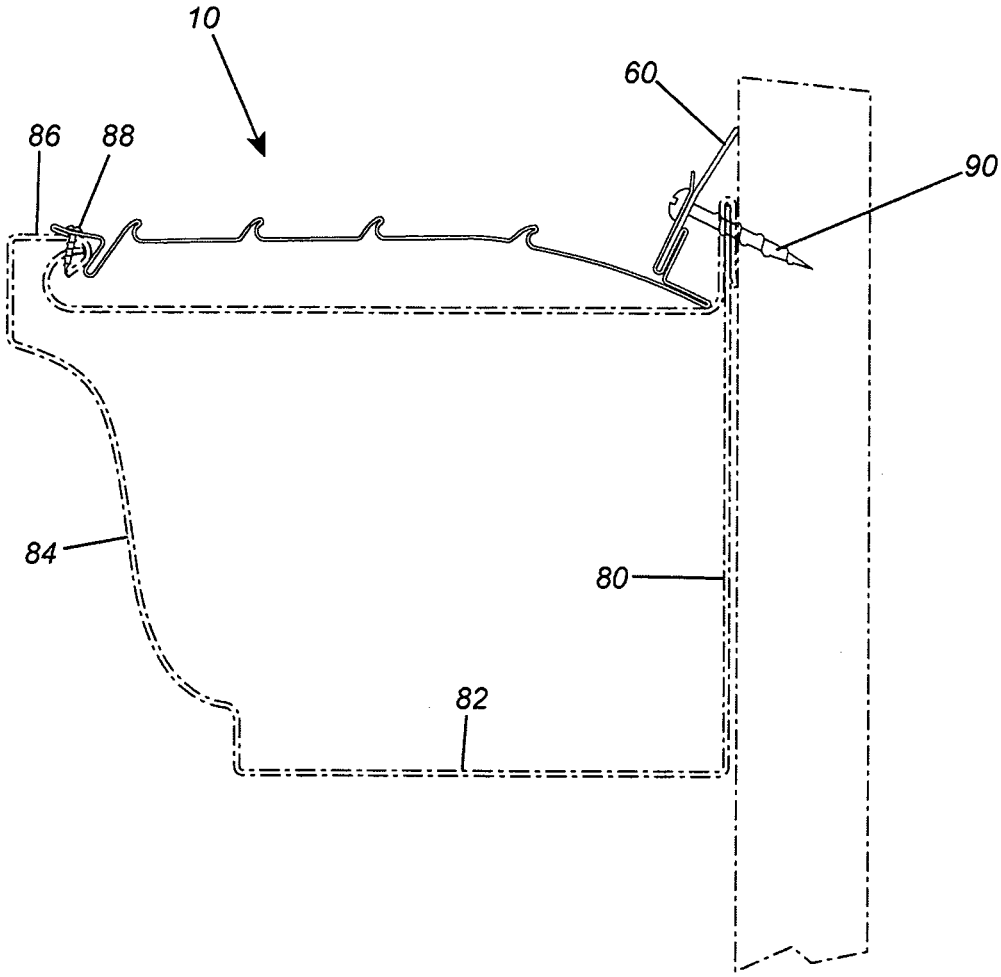
FIG. 3 is a sectional view illustrating placement of the cover on an eavestrough.

As may be seen in FIG. 3, cover 10 is installed on an eavestrough having a rear wall 80, a bottom wall 82, a front wall 84 and a top wall segment 86. Flange 48 is secured to top wall segment 86 by means of mechanical fasteners (screws) 88. The eavestrough may be supported by a hanger shown in dash dot lines. A screw 90 may extend through wall 58 and the hanger into an adjoining eave.

It will be understood that the above described embodiment is for purposes of illustration only and changes and modifications may be made thereto without departing from the spirit and scope of the invention.

I claim:

1. A cover for an eavestrough comprising a first side structure and a second side structure, a central planar portion intermediate said first side structure and said second side structure;

said central portion having a plurality of longitudinally extending sections, each of said longitudinally extending sections being separated from each other by a rollback member, each of said rollback members extending longitudinally and having one face thereof of a C-shaped configuration, each of said faces having a C-shaped configuration facing the same direction towards said second side structure; and each of said longitudinally extending sections having a plurality of apertures formed therein.

2. The cover of claim 1 wherein said first side structure joins one of said rollback members.

3. The cover of claim 2 wherein said first side structure further includes a flange for securement to an eavestrough, a downwardly extending channel being defined between said flange and said one rollback member, said channel having apertures formed therein.

4. The cover of claim 1 wherein said second side structure includes a flexible sealing strip, said sealing strip being retained by said second side structure.

5. The cover of claim 1 wherein each of said faces of said rollback members having a C-shaped configuration has apertures formed therein.

6. The cover of claim 1 wherein there are provided between two and six rollbacks.

7. The cover of claim 4 wherein said sealing strip is retained by said second side structure to extend diagonally upwardly.

8. In combination, an eavestrough having a rear wall, a bottom wall, a front wall, and an inwardly extending top wall section joining said front wall, and a cover for said eavestrough, said cover comprising a first side structure and a second side structure, a central planar portion intermediate said first side structure and said second side structure;

said central portion having a plurality of longitudinally extending sections, each of said longitudinally extending sections being separated from each other by a rollback member, each of said rollback members extending longitudinally and having one face thereof of a C-shaped configuration, each of said faces having a C-shaped configuration facing the same direction towards said second side structure; and each of said longitudinally extending sections having a plurality of apertures formed therein.

9. The cover of claim 8 wherein said first side structure joins one of said rollback members.

10. The cover of claim 9 wherein said first side structure further includes a flange for securement to an eavestrough, a downwardly extending channel being defined between said flange and said one rollback member, said channel having apertures formed therein.

11. The cover of claim 8 wherein said second side structure includes a flexible sealing strip, said sealing strip being retained by said second side structure.

12. The cover of claim 8 wherein each of said faces of said rollback-members having a C-shaped configuration has apertures formed therein.

13. The cover of claim 8 wherein there are provided between two and six rollbacks.

14. The cover of claim 11 wherein said sealing strip is retained by said second side structure to extend diagonally upwardly.

* * * * *